US007575128B2

(12) United States Patent
Schütz

(10) Patent No.: US 7,575,128 B2
(45) Date of Patent: Aug. 18, 2009

(54) CARRYING HANDLE MOUNT ON PLASTIC CONTAINERS

(75) Inventor: Udo Schütz, Selters/Westerwald (DE)

(73) Assignee: Schütz GmbH & Co. KGaA, Selters/Westerwald (DE)

( * ) Notice: Subject to any disclaimer, the term of this patent is extended or adjusted under 35 U.S.C. 154(b) by 667 days.

(21) Appl. No.: 11/009,953

(22) Filed: Dec. 10, 2004

(65) Prior Publication Data

US 2005/0127080 A1 Jun. 16, 2005

(30) Foreign Application Priority Data

Dec. 11, 2003 (DE) ..... 103 57 936

(51) Int. Cl.
*B65D 25/28* (2006.01)

(52) U.S. Cl. ..... 220/759; 16/425; 220/764

(58) Field of Classification Search ..... 220/758, 220/759, 762, 764, 770; 16/110.1, 406, 422, 16/426, 425

See application file for complete search history.

(56) References Cited

U.S. PATENT DOCUMENTS 5,582,315 A * 12/1996 Reid ..... 220/254.4
5,769,254 A * 6/1998 King et al. ..... 215/330

* cited by examiner

*Primary Examiner*—Anthony D Stashick
*Assistant Examiner*—Harry A Grosso
(74) *Attorney, Agent, or Firm*—Friedrich Kueffner

(57) ABSTRACT

A carrying handle mount on a plastic container has a mounting plate of plastic material. A carrying handle is connected to the mounting plate. A securing plate of plastic material is connected to the plastic container, wherein the mounting plate is connected by screwing to the securing plate. An overtightening protection device for the mounting plate is provided to protect the mounting plate from overtightening when screwing the mounting plate onto the securing plate. An anti-rotation device for the mounting plate is provided for protecting the mounting plate from becoming detached from the securing plate.

9 Claims, 5 Drawing Sheets

CARRYING HANDLE MOUNT ON PLASTIC CONTAINERS

BACKGROUND OF THE INVENTION

1. Field of the Invention

The invention relates to a carrying handle mount on plastic containers, in particular, blow-molded plastic barrels, the mount comprising a mounting plate made of plastic material for securing a carrying handle on a securing plate that is attached to a container jacket or a container wall or is formed as a unitary part of the container jacket or the container wall.

2. Description of the Related Art

European patent 0 413 836 B1 describes a carrying handle mount of this kind wherein the mounting plate of the carrying handle is designed to spread to a limited extent by means of a partitioning gap and is positively secured by means of an undercut that is formed on the outer edge at the underside of the mounting plate on the flange-like projecting outer edge of a mushroom-shaped projection formed on the container jacket. This type of carrying handle attachment entails the risk that, when during transport the container drops onto the carrying handle, the mounting plate with the carrying handle will become detached from the mushroom-like projection of the container wall upon impact on the ground or on a loading surface and will be damaged.

SUMMARY OF THE INVENTION

It is an object of the present invention to further develop a carrying handle mount of the aforementioned kind for plastic containers with regard to an improvement of the transport safety of the container.

In accordance with the present invention, this is achieved in that an overtightening protection device and an anti-rotation device are provided for the mounting plate of the carrying handle to be attached by screwing to the securing plate of the container.

The overtightening protection device of the carrying handle mount on plastic containers according to the invention prevents the threads from being damaged when screwing the threaded socket, provided with an inner thread and formed on the mounting plate of the carrying handle, onto the threaded pin provided with an outer thread and formed on the securing plate of the container, and the anti-rotation device of the mounting plate of the carrying handle that can be connected by screwing to the securing plate provided on the container prevents that the carrying handle or handles when lifting the container become detached from the container.

DESCRIPTION OF THE PREFERRED EMBODIMENTS

Figure 1:
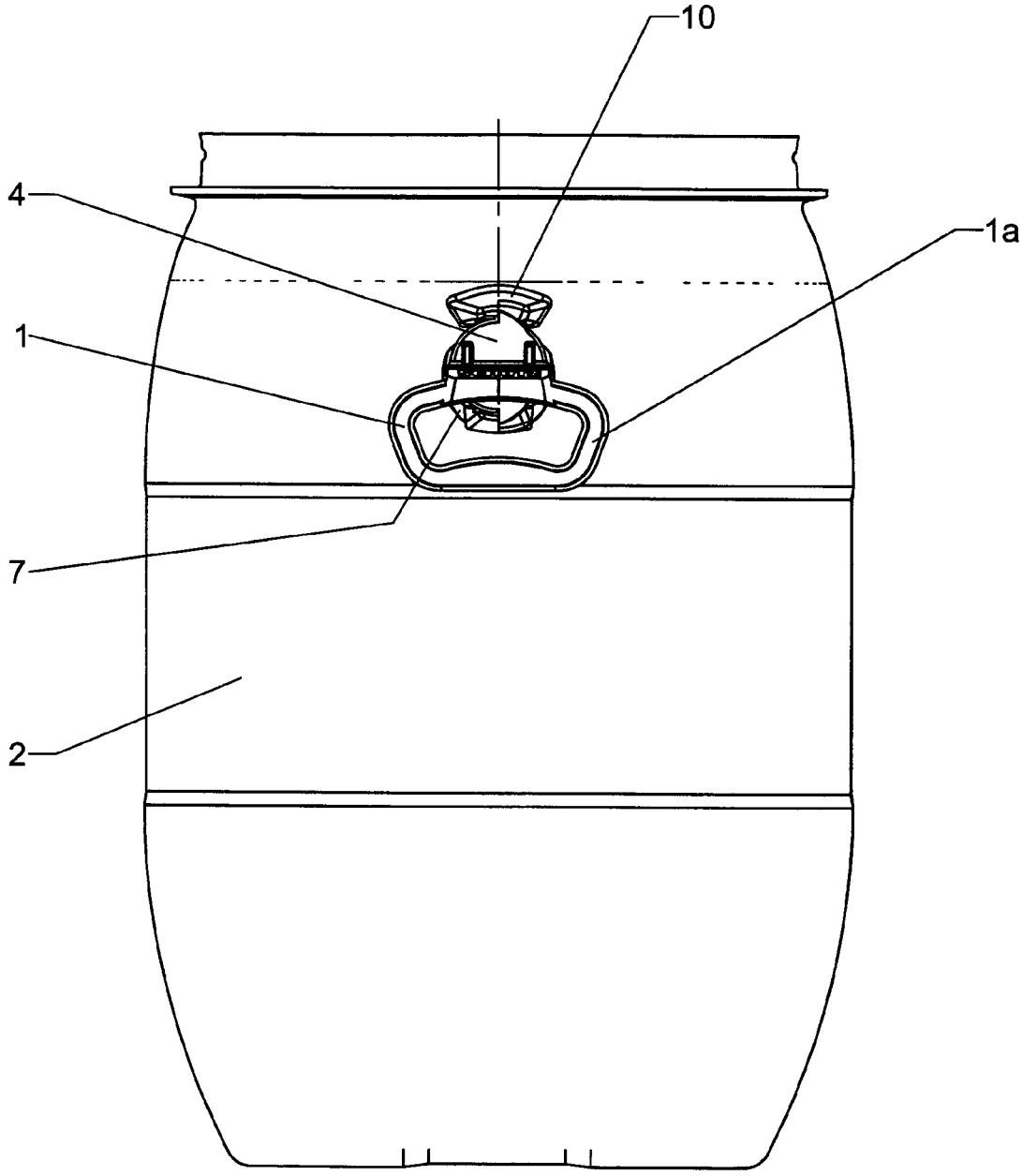
FIG. 1 is a side view of a plastic barrel with a carrying handle attached thereto.
Figure 2:
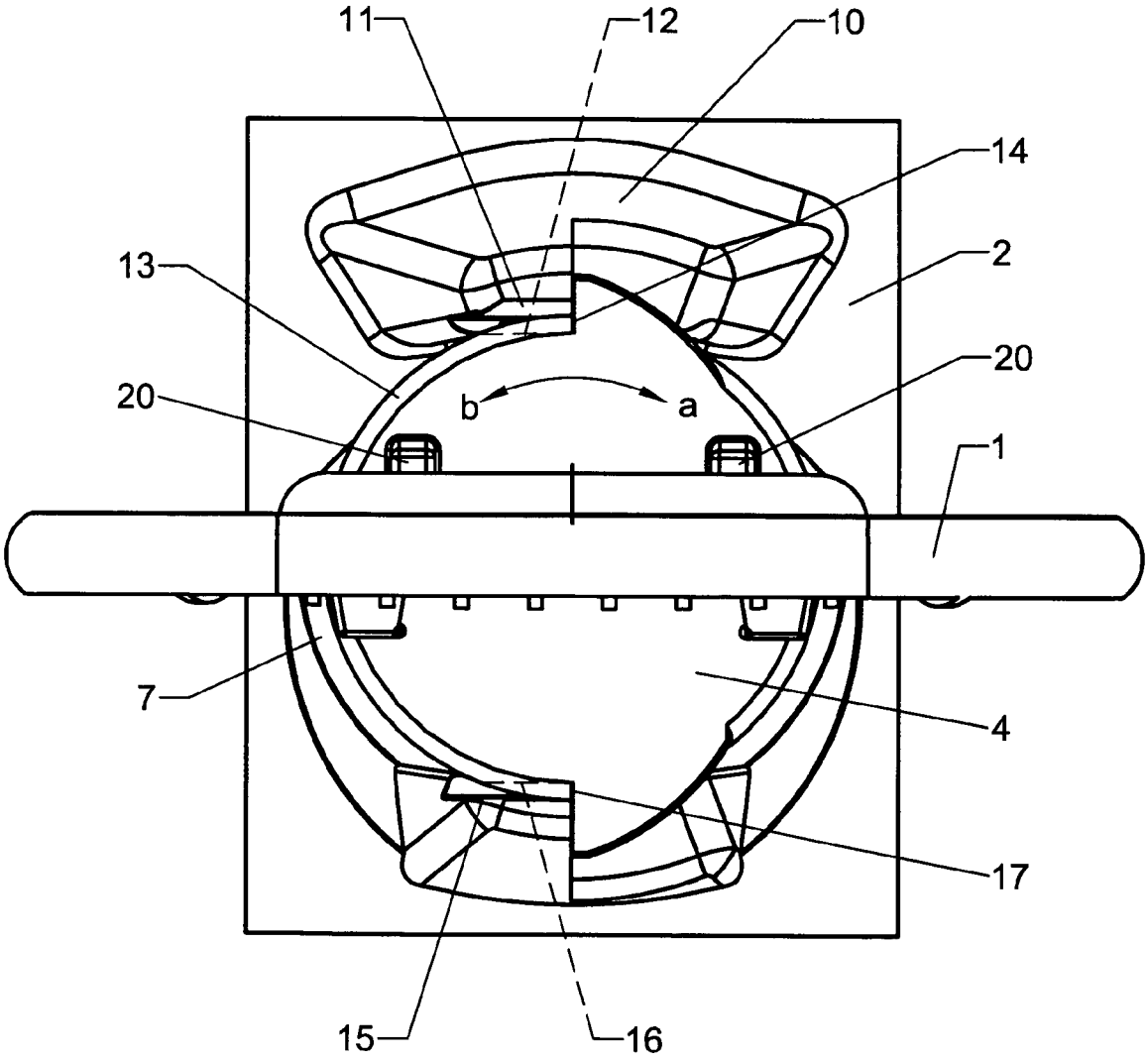
FIG. 2 is a front view of the carrying handle mount according to FIG. 1 in a perspective detail view.
Figure 3:
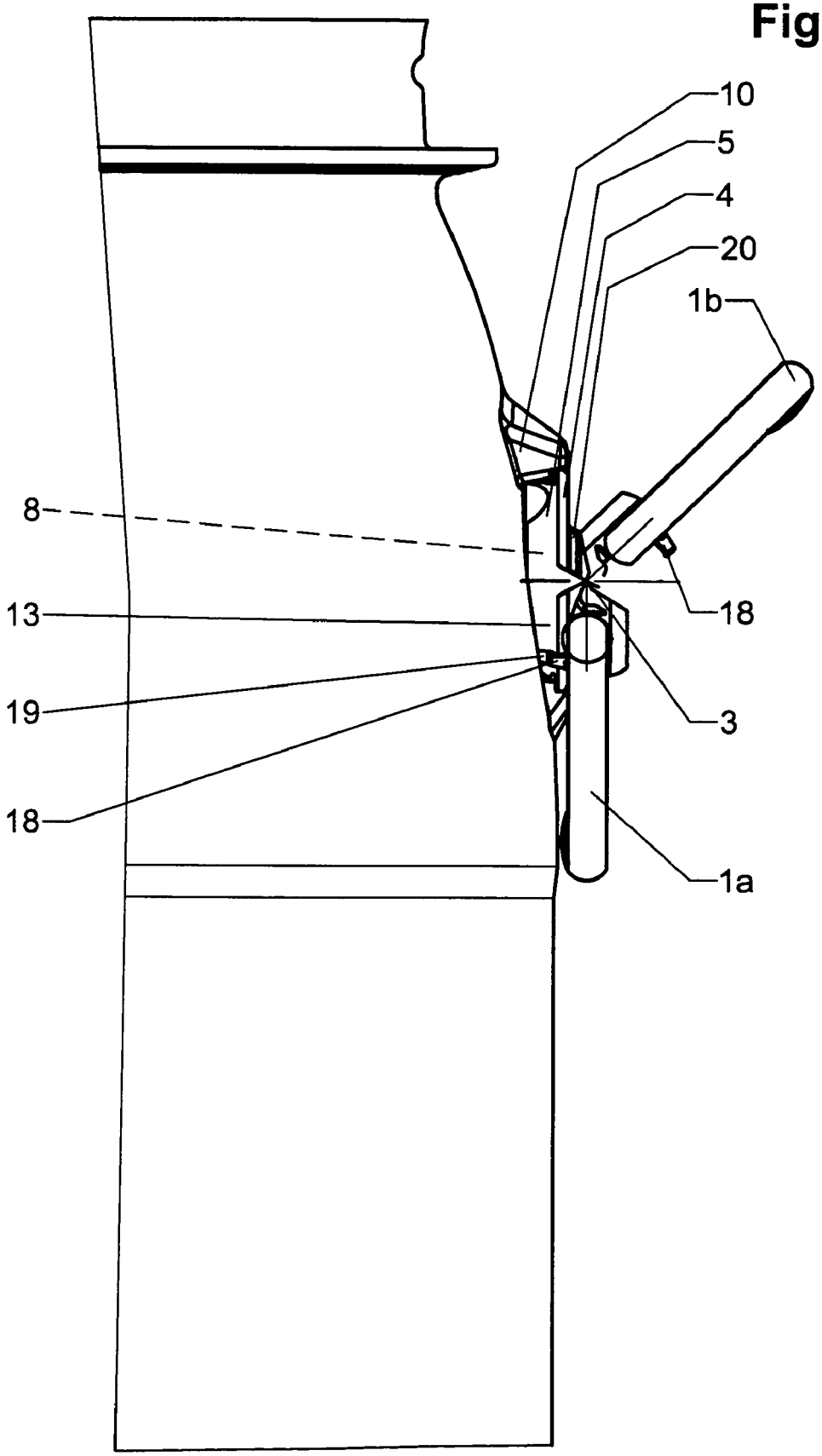
FIG. 3 is a side view of the carrying handle mount attached to the plastic barrel.
Figure 4:
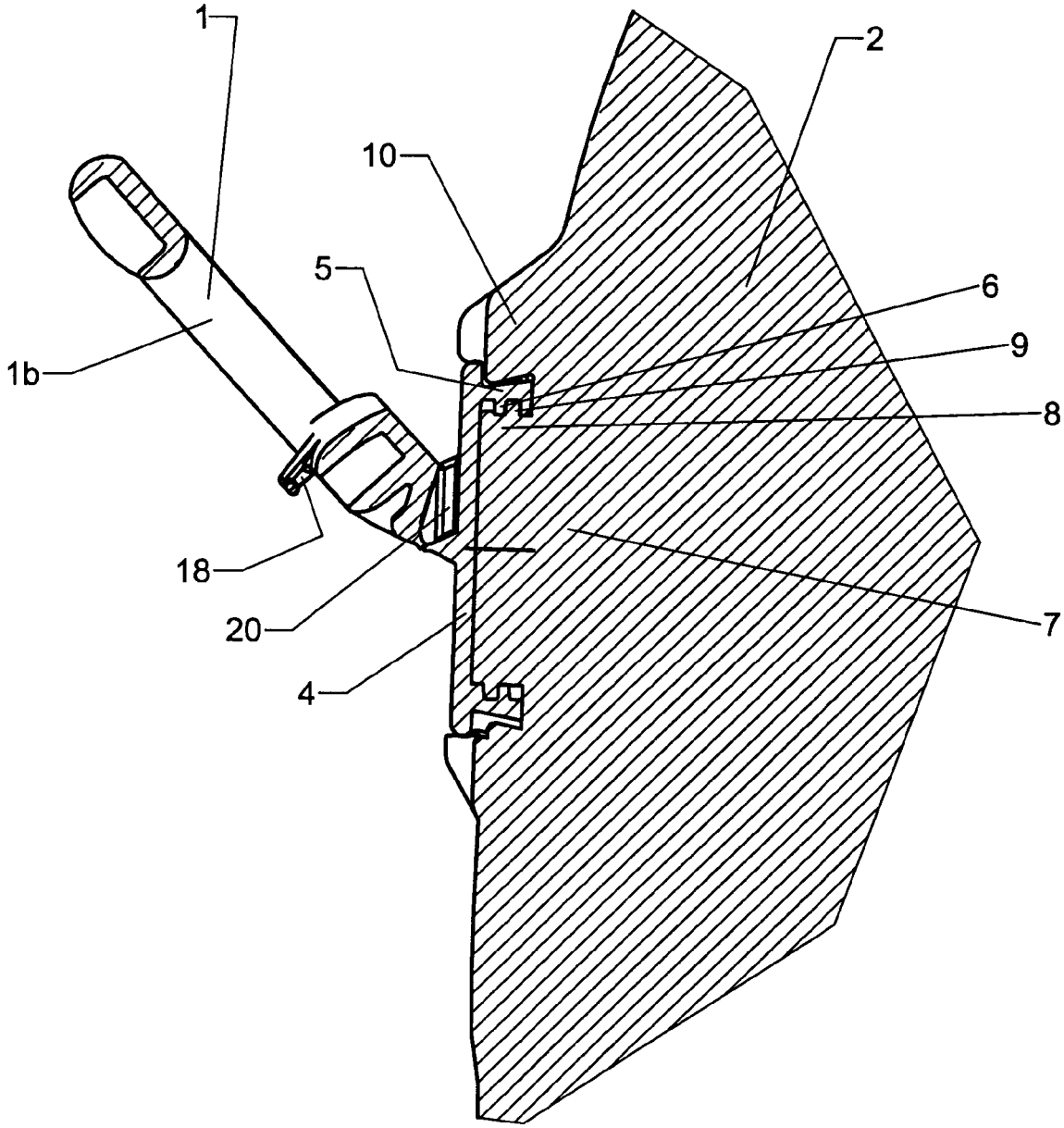
FIG. 4 is an enlarged longitudinal section view of the carrying handle mount.
Figure 5:
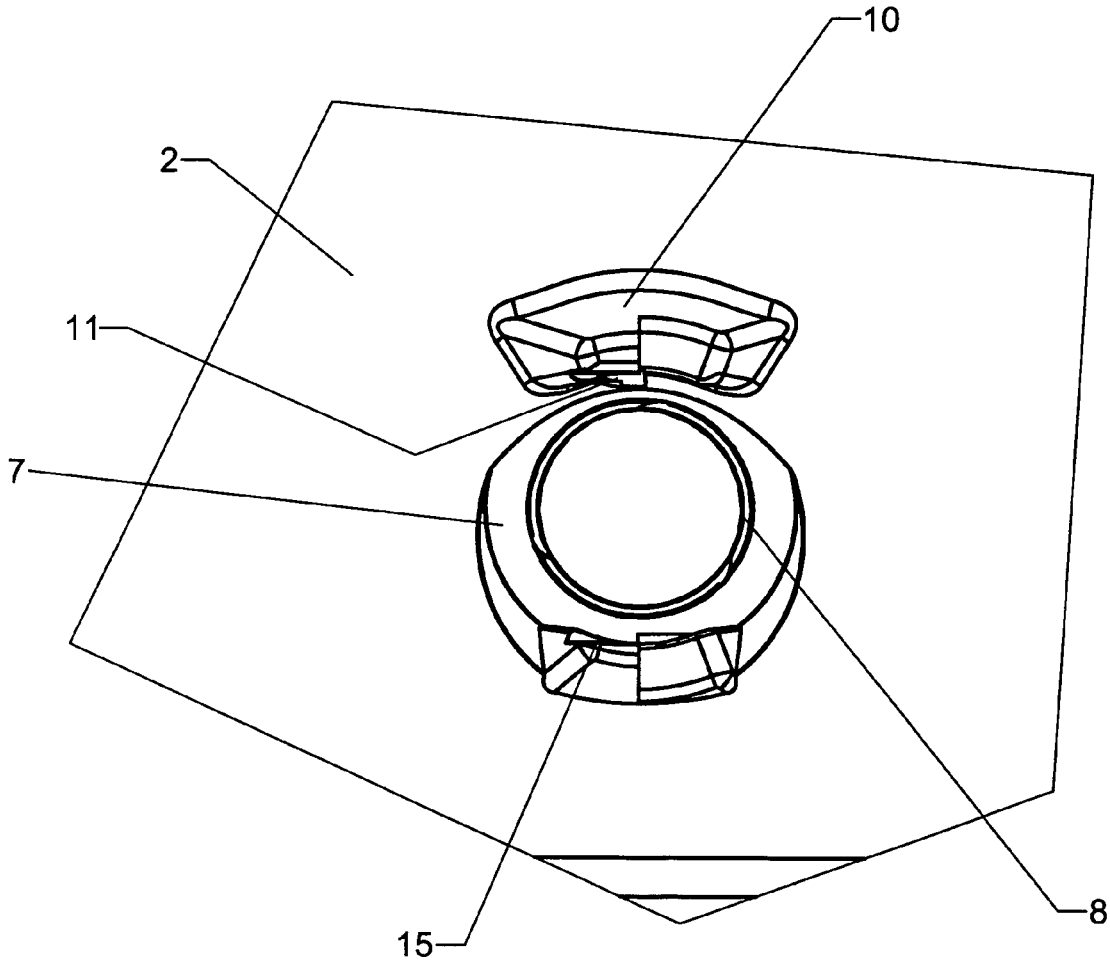
FIG. 5 is a perspective detail front view of the components of the carrying handle mount formed as unitary parts of the container without showing the mounting plate of the carrying handle.

The two carrying handles 1 that are manufactured as injection-molded plastic parts for a plastic container 2, for example, a plastic barrel, are designed as drop handles and are connected by means of a hinge-like transition 3 (FIG. 3) forming a hinge on a mounting plate 4. On the mounting plate 4 of the carrying handles 1, a threaded socket 5 with an inner thread 6 is provided for screwing the mounting plate 4 in the direction of arrow a onto a threaded pin 8 provided with an outer thread 9 and formed as a unitary part of the securing plate 7 on the container 4. The threads 6, 9 are triple threaded arrangements, and the beginning of each thread of the triple threaded arrangement is displaced by 120°, respectively, relative to the other two threads of the triple threaded arrangement, respectively. The securing plate 7 is blow-molded onto the plastic container 2 that is manufactured by blow-molding.

On a projection 10 of the container 2 a springy locking tongue 11 is formed that constitutes an anti-rotation device for the mounting plate 4. The mounting plate 4 of a carrying handle 2 connected by screwing to the securing plate 7 is prevented from becoming detached by rotating in the direction of arrow b in that the locking tongue 11 engages a recess 12 in the outer rim 13 of the round mounting plate 4 and rests against the stop edge 14 of the recess 12.

On the securing plate 7 of the container 2, a second springy locking tongue 15 is formed as a unitary part. The second locking tongue 15 provides an overtightening protection device when screwing the threaded socket 5 of the mounting plate 4 of a carrying handle 1 onto the threaded pin 8 in that the locking tongue 15 of the securing plate 7 engages a second recess 12 on the outer rim 13 of the mounting plate 4 and rests against the stop edge 17 of the recess 16.

The locking tongues 11, 15 that are formed on the projection 10 and the securing plate 7 of the container 2 as well as the recesses 12, 16, that are provided on the outer rim 13 of the mounting plate 4 of the carrying handle 1 for locking the locking tongues 11, 15, are arranged diagonally opposite one another.

Two locking noses 18 are formed on the carrying handles 1; for locking the carrying handles 1 in the folded position 1*a* pivoted against the container 2, the locking noses 18 engage or snap into a locking recess 19, respectively, provided in the outer rim 13 of the mounting plate 4 of the carrying handle 1.

A stop comprised of two stop bars 20 for locking the carrying handles 1 in the folded-out carrying position 1*b* is provided, wherein the stop bars 20 are formed as unitary parts of the mounting plate 4.

While specific embodiments of the invention have been shown and described in detail to illustrate the inventive principles, it will be understood that the invention may be embodied otherwise without departing from such principles.

What is claimed is:

1. A carrying handle mount on a plastic container, the carrying handle mount comprising:

a mounting plate of plastic material;

a carrying handle connected to the mounting plate;

a securing plate of plastic material adapted to be connected to a plastic container, wherein the mounting plate is connected by screwing to the securing plate;

an overtightening protection device for the mounting plate to protect the mounting plate from overtightening when screwing the mounting plate onto the securing plate;

an anti-rotation device for the mounting plate for protecting the mounting plate from becoming detached from the securing plate, wherein the mounting plate has a threaded socket having an inner thread and wherein the securing plate has a threaded pin provided with an outer thread, wherein the threaded socket is screwed onto the threaded pin;

the anti-rotation device comprises a first springy locking tongue adapted to be formed on a projection of the container and further comprises a first recess in an outer edge of the mounting plate that is round, wherein the first springy locking tongue lockingly engages the first recess and rests against a first stop edge of the first recess;

the overtightening protection device comprises a second springy locking tongue formed on the securing plate and further comprises a second recess in the outer edge of the mounting plate, wherein the second springy locking tongue lockingly engages the second recess and rests against a second stop edge of the second recess.

2. The carrying handle mount according to claim 1, wherein the first and second springy locking tongues are arranged diagonally opposite one another and the first and second recesses are arranged diagonally opposite one another.

3. The carrying handle mount according to claim 1, wherein the carrying handle is a drop handle and is connected by a transition forming a hinge to the mounting plate.

4. The carrying handle mount according to claim 1, wherein the carrying handle has at least one locking nose and wherein the mounting plate has an outer rim provided with at least one locking recess, wherein the at least one locking nose engages the at least one locking recess in a folded position of the carrying handle in which position the carrying handle is pivoted against the container for locking the carrying handle in the folded position.

5. The carrying handle mount according to claim 1, wherein the mounting plate has a stop for locking the carrying handle in a folded-out carrying position.

6. The carrying handle mount according to claim 5, wherein the stop is comprised of two stop bars formed on the mounting plate.

7. The carrying handle mount according to claim 1, wherein the securing plate is formed by blow-molding on the container.

8. The carrying handle mount according to claim 1, wherein the container is a blow-molded plastic barrel.

9. The carrying handle mount according to claim 1, wherein the container has a container wall or a container jacket, wherein the securing plate is adapted to be attached to the container wall or the container jacket or formed as a unitary part of the container wall or container jacket.

* * * * *